United States Patent [19]

Gersbeck et al.

[11] Patent Number: 4,932,855

[45] Date of Patent: Jun. 12, 1990

[54] PRESS FOR THE CONTINUOUS PRODUCTION OF CHIP-BOARDS AND FIBER BOARDS

[75] Inventors: Rolf Gersbeck, Ronnenberg; Karsten Möller, Hanover, both of Fed. Rep. of Germany

[73] Assignee: Hermann Berstorff Maschinenbau GmbH, Hanover, Fed. Rep. of Germany

[21] Appl. No.: 296,829

[22] Filed: Jan. 13, 1989

[30] Foreign Application Priority Data

Jan. 15, 1988 [DE] Fed. Rep. of Germany ..... 3800994

[51] Int. Cl.[5] ..... B28B 3/12; B28B 5/02

[52] U.S. Cl. ..... 425/193; 100/153; 100/170; 425/367; 425/375

[58] Field of Search ..... 425/186, 193, 194, 185, 425/367, 373; 100/153, 154, 168, 170

[56] References Cited

U.S. PATENT DOCUMENTS

| | | | |
|---|---|---|---|
| 2,971,218 | 2/1961 | Bierer | 425/367 |
| 3,782,875 | 1/1974 | Olschewski | 425/367 |
| 3,936,258 | 2/1976 | Lake | 425/367 |
| 3,938,927 | 2/1976 | Brinkmann et al. | 425/373 |
| 3,973,894 | 8/1976 | Lindner et al. | 425/373 |
| 4,501,669 | 2/1985 | Hakansson et al. | 100/153 |
| 4,699,050 | 10/1987 | Heise | 425/367 |
| 4,704,191 | 11/1987 | Wedel | 100/153 |
| 4,796,452 | 1/1989 | Schiel | 100/168 |

FOREIGN PATENT DOCUMENTS

| | | | |
|---|---|---|---|
| 2308696 | 8/1974 | Fed. Rep. of Germany . | |
| 2329599 | 1/1975 | Fed. Rep. of Germany | 425/373 |
| 2724060 | 1/1986 | Fed. Rep. of Germany . | |
| 820225 | 9/1959 | United Kingdom | 425/367 |

*Primary Examiner*—Jay H. Woo
*Assistant Examiner*—K. P. Nguyen
*Attorney, Agent, or Firm*—Foley & Lardner, Schwartz, Jeffery, Schwaab, Mack, Blumenthal & Evans

[57] ABSTRACT

A press for the continuous production of thin chipboard and fibreboards a heated, rotatable central pressing drum, which is mounted in a support arrangement which includes a plurality of interconnected support members and a plurality of pressure rollers, disposed around a major portion of the periphery of the drum. An endless steel belt is guided around the major portion of the periphery of the drum between the drum and the pressure rollers. The belt carries the material from which the boards are to be produced and can be tensioned. The material, a chip or fibre layer mixed with a binding agent is subjected to a surface pressure between the endless steel belt and the pressing drum, and to a linear pressure in the nips between the pressing drum and the pressure rollers. The axle of the drum is made radially adjustable relative to the axles of the pressure rollers, by so doing, it is possible for the press to be put into operation in its empty state, without causing damage to the drum, to the endless steel belt or to the pressure rollers. This is true even if very thin chipboards or fibreboards are being produced.

4 Claims, 3 Drawing Sheets

PRESS FOR THE CONTINUOUS PRODUCTION OF CHIP-BOARDS AND FIBER BOARDS

FIELD OF THE INVENTION

The present invention relates to a press for the continuous production of chip-boards and fiberboards. More particularly, the present invention relates to a press which comprises a heated, rotatable central pressing drum mounted in support members, a plurality of pressure rollers and a tensionable endless steel belt which passes around the pressing drum and the pressure rollers. In use a chip or fibre layer, mixed with a binding agent is transported on the belt and is subjected to a surface pressure between the belt and the central pressing drum and to a linear pressure in the nips between the central drum and the pressure rollers.

BACKGROUND OF THE INVENTION AND PRIOR ART DISCUSSION

A press of the above-described general type is disclosed in German Patent Specification No. 2724060. Presses of this type have since been further developed in order to achieve a higher output. For this purpose, it has proved necessary to extend the pressing section, while the time taken for the binding agents to harden or set has remained constant. In the case of rotary presses, that is to say, presses having a rotating drum, wherein the pressing occurs between the outer casing of the drum and an endless steel belt, which belt passes partway around the periphery of the drum and is subjected to tensile stress, an extension of the pressing section necessitates an increase in the diameter of the drum employed. The most modern presses of this type have drums with a diameter of 5 m, a roller surface length of about 3 m and a drum weight of about 110 tons.

Such large presses suffer from certain disadvantages because, due to the necessity of providing mounting and manufacturing tolerances which permit the press to start-up and to operate when empty. By providing these tolerances, damage is sustained by the endless steel belt, by the outer drum casing and by the guide rollers, which rollers simultaneously apply a pressure. This is because these machine parts are in contact with one another, metal-to(--)metal, if no material is being pressed therebetween.

On the other hand, the output achieved by enlarging the drum diameter from, for example, 3 meters to 5 meters is substantially improved. Thus, it is possible to process continuously a web having a thickness of 3 mm, thereby producing an output of up to approximately 40 m/min. This represents, on average, an output increase in excess of 200%.

OBJECTS OF THE INVENTION

The present invention seeks to provide a continuously operating rotational press which is generally of the above-described type, but which enables a high, continuous output to be achieved. Simultaneously, however the present invention seeks to provide a press in which damage to the drum casing, to the endless steel belt and to the guide and pressure-applying rollers when there is no material present in the press is obviated or at least minimized. The absence of material from the press occurs both during the start-up phase of a pressing operation and at the end of the operation.

The present invention also seeks to provide a press which permits the production of extremely thin chip board or fiberboard webs, for example, of a thickness of one millimetre within extremely low tolerances while the web produced still has a high specific strength and a good torque resistance and impact resistance.

SUMMARY OF THE INVENTION

According to the present invention, there is provided a press for the continuous production of thin chipboards and fibreboards comprising:

(a) a pressing drum assembly comprising a pressing drum, axle means mounting said drum for rotation, said axle means including journal means, primary bearing means mounting said journal means of said axle for rotation thereof and means for heating said drum;

(b) an endless steel belt passing around a major portion of the periphery of said drum and capable of carrying material to be pressed such that said material is disposed between said belt and said drum;

(c) guide and reversing roller means supporting said belt and tensioning roller means for tensioning said belt;

(d) a plurality of pressure rollers disposed around said major portion of said periphery of said drum and acting on said belt to urge said material into contact with said drum such that said material is pressed;

(e) lateral support means mounting said drum assembly, each said lateral support means comprising a plurality of interconnected support members, one of said support members carrying said bearing means in which said axle of said drum is journalled to rotate; and (f) adjustment means acting on said axle means of said drum for providing radial adjustment of said axle to eliminate play between said bearing means and said support means and simultaneously to eliminate play between said interconnected support members.

The radial adjustability of the axle of the pressing drum relative to the axles of the guide and pressure-applying rollers ensures that the axle of the very heavy pressing drum is secured at one point. Once such setting has been achieved therefore, the gap or spacing between the periphery of the drum and the pressure-application and guide rollers is accurately maintained. This prevents damage being caused to the steel belt and to the surfaces of the rollers and drum because the mounting tolerances and clearances between the individual component parts, such as in the mounting of the bearing in the supports and between the interconnected support members of the press, are effectively eliminated. Such tolerances and clearances are inevitable because the press is, of necessity, very large.

The advantage of a press according to the present invention becomes apparent during the production of extremely thin webs having a thickness of, for example 1 mm, such a web thickness being smaller than the mounting clearance of the component parts of the press.

Because of the definitive radial adjustment of the pressing drum axle, the drum can be positioned exactly, even though it is very large. Accordingly, the thickness of the web being produced is accurately controlled despite the fact that the mounting tolerances of the component parts, such as the supports and bearings, may amount to as much as 1.5 mm.

In a preferred embodiment said adjustment means comprises secondary bearing means mounting said journal means of said axle of said drum, said secondary bearing means being disposed axially outwardly of said primary bearing means between said primary bearing means and the free end of said journal means, said second bearing means each including bearing body means, and hydraulic piston and cylinder arrangements acting on said bearing body means, said press further including bracket means mounted on said support means wherein said hydraulic piston and cylinder arrangements each include opposed first and second end regions, said first end region acting on said bearing body means and said bracket means supporting said second end region. This provides the adjustment of the axle and eliminates the play between the support members and the play between the bearings of the drum axle and the support. The adjustment is controlled by the pressure introduced by the hydraulic cylinders disposed at each end of the axle. The large pressing drum can, in consequence, be positioned exactly relative to the pressure-applying rollers.

Advantageously, said hydraulic piston and cylinder arrangement comprises a piston and cylinder assembly and guide arm means disposed in parallel to said piston and cylinder assembly, both said piston and cylinder assembly and said guide arm means having opposed first and second end regions, said bracket means supporting both said second end regions; wherein said bearing body means further includes means pivotally mounting said first ends of both said piston and cylinder assembly and said guide arm; and wherein both said piston and cylinder assembly and said guide arm are disposed above said axle.

Desirably, the hydraulic piston and cylinder arrangement comprises two piston and cylinder assemblies in parallel to and adjacent one another, both said assemblies being disposed on the same side of the horizontal plane passing through said axle, both said pistol and cylinder assemblies having opposed first and second end regions, said bracket means supporting both said second end regions; with said bearing body means further including means pivotally mounting said first ends of both said piston and cylinder assemblies. This arrangement is of particular use if the adjustment forces required are large, because the adjustment force is, effectively, doubled.

BRIEF DESCRIPTION OF THE DRAWINGS

Certain preferred embodiments of a press in accordance with the present invention will be further described, by way of example, with reference to the accompanying drawings, in which.

DESCRIPTION OF PREFERRED EMBODIMENTS

Figure 1:
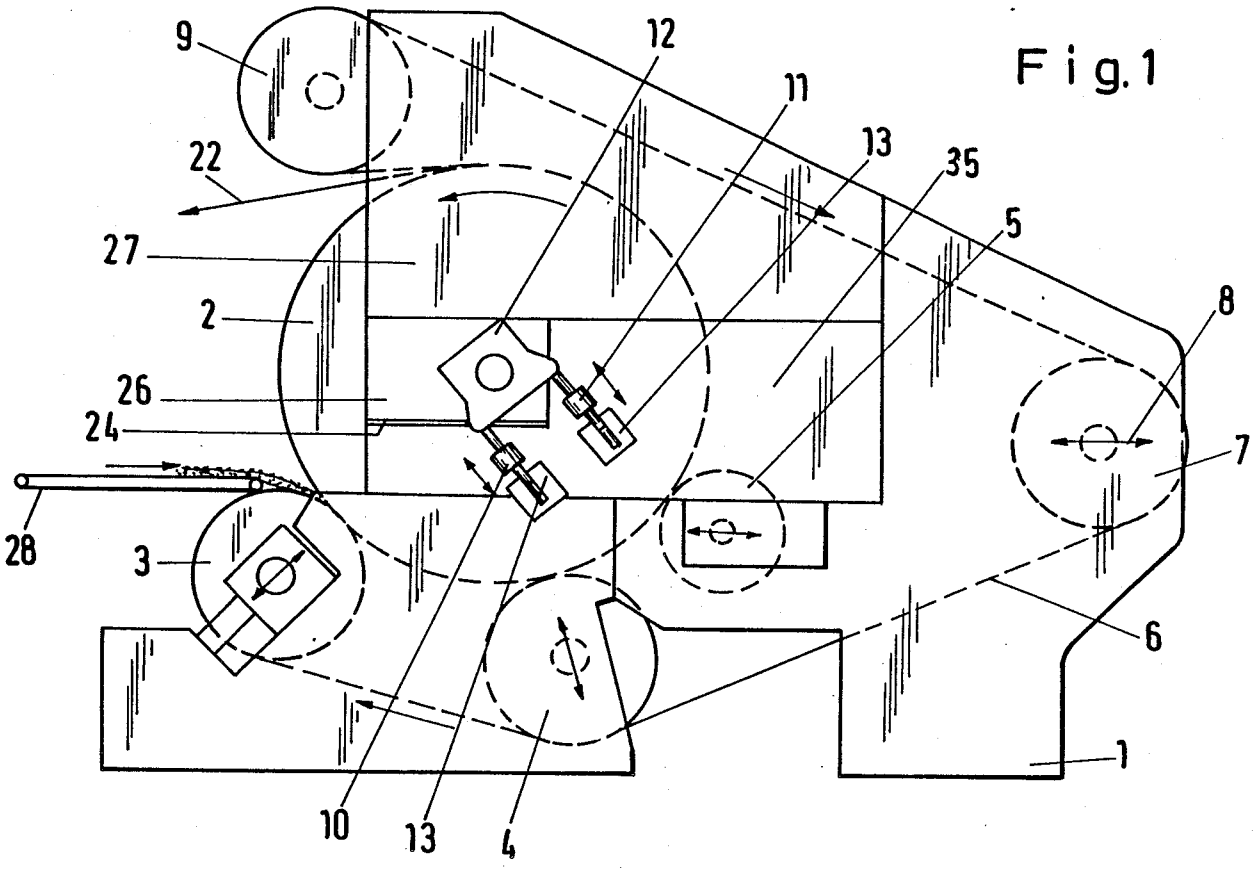
FIG. 1 is a schematic, longitudinal sectional view through a continuously operating press in accordance with the present invention.

In FIG. 1, there is shown a central pressing drum Z which is both heatable and rotatable and which is accommodated in a support member 1. Rotatable guide and pressure application rollers 3, 4 and 5 are disposed around the periphery of the drum 2. An endless steel belt 6 is also provided which is subjected to a high tensile stress by means of a tensioning roller 7. The belt 6 has a first run which passes between the surface of the drum 2 and the surfaces of the guide and pressure rollers 3, 4 and 5 and a second run which, after passing over a reversing roller 9, passes over the tensioning roller 7 and the surfaces of the guide and pressure rollers 4 and 3 remote from the drum 2. In the embodiment shown, the guide and pressure roller 3 also acts as a reversing roller.

The pressure application rollers 3, 4 and 5 are each adjustable, by means of hydraulic cylinders (not shown), in a direction towards and away from the axis of rotation of the drum 2.

The adjustment of the drum 2 with respect to the belt 6 and to the rollers 3, 4 and 5 is effected by means of hydraulic piston and cylinder arrangements 10 and 11 which are pivotally mounted on a bearing 12 in which the drum 2 is journalled to rotate. This bearing 12 is provided in addition to the main bearing 16 (shown in FIG. 4) in which the drum is journalled to rotate. The piston and cylinder arrangements 10 and 11 are mounted on brackets 13 which, in turn, are mounted on the support member 1.

Figure 2:
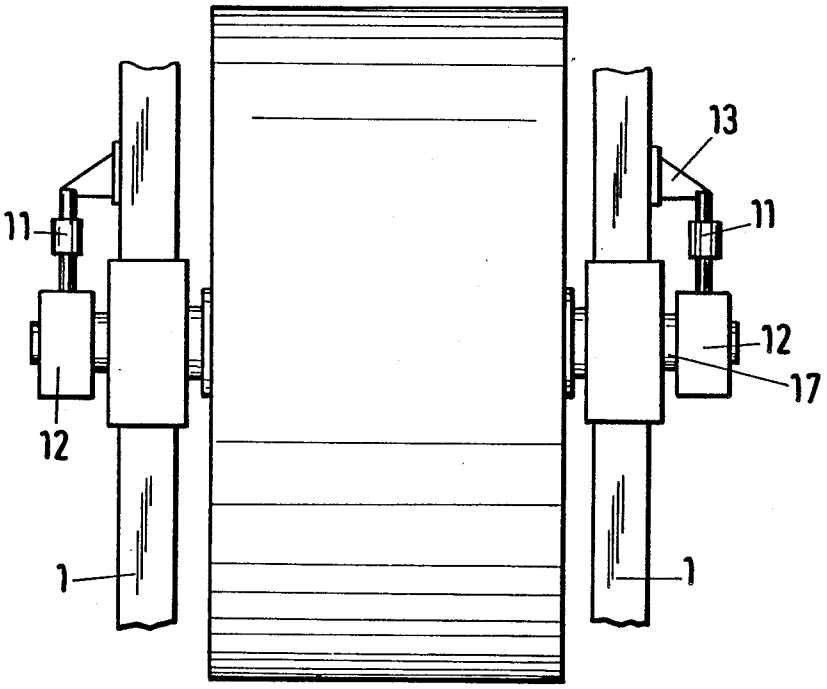
FIG. 2 is a plan view of a pressing drum and adjustment means therefore forming part of the press shown in FIG. 1.

In the plan view shown in FIG. 2, the adjustment means are shown as being disposed on each side of the drum 2. These can operate alternatively, even if only one centrally disposed hydraulic cylinder 11, which is supported on the bracket 13 disposed above the drum axle 17, is provided.

Figure 3:
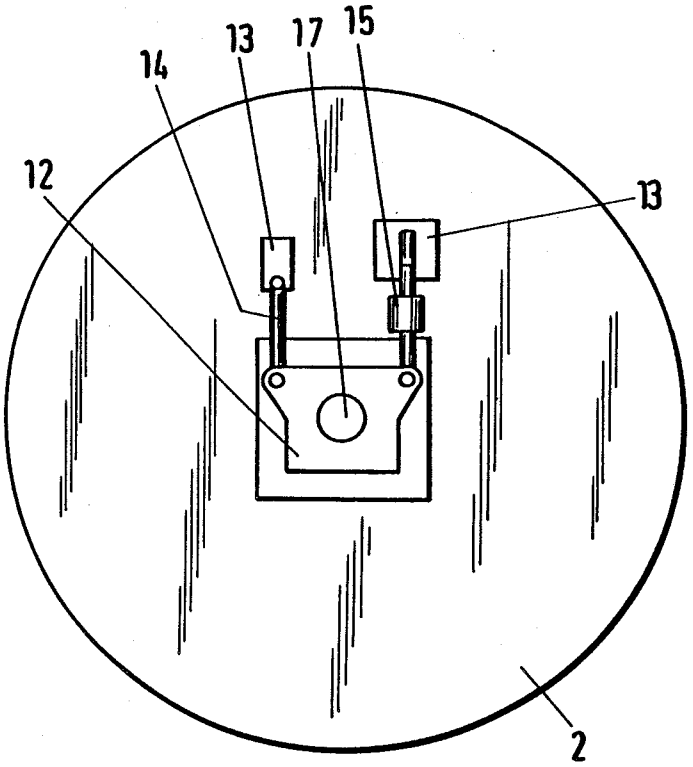
FIG. 3 is a side elevational view of an alternative embodiment of the adjustment means shown in FIG. 2.

In FIG. 3, and alternative embodiment of the adjustment means is shown, which comprises a hydraulic piston and cylinder arrangement 15 and a guide member 14, both of which are supported on brackets 13. By actuating the hydraulic cylinder 15, the additional bearing 12 is either raised or lowered, depending on the direction of the stroke of the adjustment means.

Figure 4:
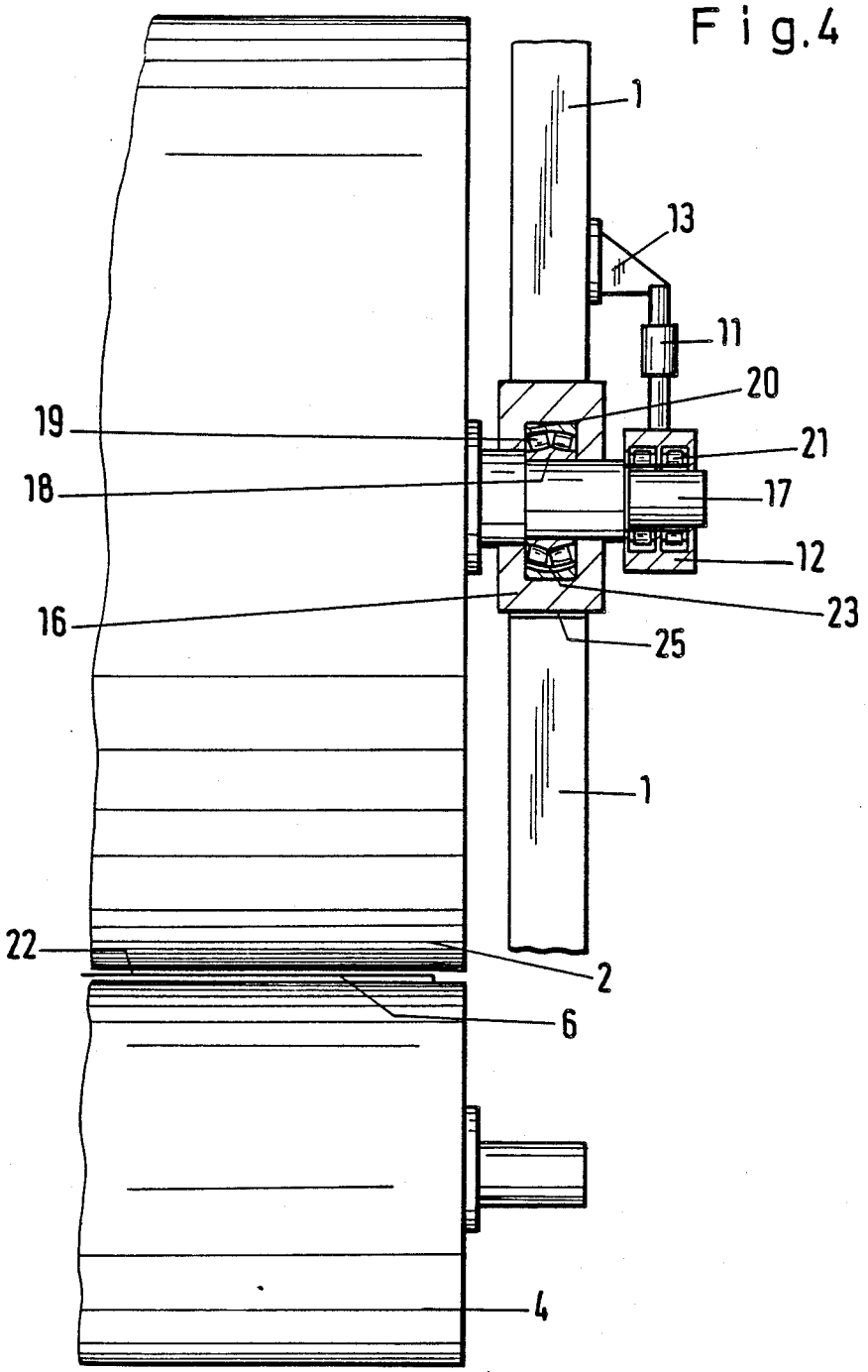
FIG. 4 is a plan view, on an enlarged scale of the adjustment means shown in FIG. 2 and in which further detail can be seen.

FIG. 4 shows, in greater detail, the adjustment means provided on one side of the pressing drum 2. In this Figure can be seen the axle 17 of the drum 2 which is journalled to rotate in the primary or main bearing 16, Such bearing 16 comprises a bearing body housing an inner bearing ring 18, roller bodies 19 and an outer bearing ring 20. The axle 17 is also journalled to rotate in the secondary or additional bearing 12 disposed nearer the end of the axle 17 than the primary bearing 16. The bearing 12 comprises a bearing body housing single-row cylinder bearing rollers 21. A hydraulic piston and cylinder arrangement 11, which is supported on the bracket 13 mounted on the support 1, is pivotally mounted on the bearing body of the secondary bearing 12. By actuation of the hydraulic piston and cylinder arrangement 11, the secondary bearing 12 is caused to move, downwardly as shown in FIG. 4. In so doing, the mounting tolerance 25 between the bearing body of the primary bearing 16 and the support 1, and the clearance 23 between the roller bodies 19 and the outer ring 20 of the primary bearing are both eliminated.

In the embodiment shown in FIG. 1, the mounting clearance 24 between individual support members 35, 26 and 27 of the support 1 is eliminated by actuation of the hydraulic piston and cylinder arrangements 10 and 11. It will be readily appreciated that, in view of the size and weight of the drum 2 and the remainder of the press, the support therefor must be substantial. It is for this reason that the support 1 is sub-divided into individual support members such as 35, 26 and 27 because the production of a one-piece support would be extremely difficult. However, the support members must be interconnected by, for example, very large screws and this gives rise to the gaps such as 24.

When a fibre board web, having a thickness of 1.5 mm, is to be produced by pressing, an adjustable pressing gap of this thickness must be formed between the guide and pressure-applying rollers 3, 4 and 5 and the drum 2. Moreover, the thickness of the steel belt 6, usually about 1.8 mm, which carries the fibre through the gap must also be taken into consideration.

In consequence, to avoid flat-rolling of the endless steel belt when the system is started up, the drum 2 is raised by means of the hydraulic piston and cylinder arrangements 10 and 11, whereby the mounting clearance 24 between the support members 35 and 26, amounting to about 1.5 mm, does not and cannot affect the web thickness. Furthermore, the clearance 23 between the outer ring 20 and the roller bodies 19 of the main bearing 16 is eliminated, as is the mounting clearance 25 between the bearing body of the main bearing 16 and the support 1.

The fibre layer, which has previously been spread, can now be introduced into the press by means of a conveyor belt 28 onto the belt 6. Passage of the belt between the drum 2 and the rollers 3, 4 and 5 causes the production of a fiberboard 22 having a thickness of 1.5 mm. No damage, however, is sustained by the machine parts during the start-up phase. If the press is operated when empty, the hydraulic piston and cylinder arrangements 10 and 11 likewise prevent the drum, which weighs about 110 tons, from acting detrimentally upon the steel belt 6 which is disposed between the guide and pressure-applying rollers 3, 4 and 5 and the drum 2, or upon the pressure-applying rollers 3, 4 and 5 themselves.

We claim:

1. A press for the continuous production of thin chipboards and fibre-boards comprising:

(a) a pressing drum assembly comprising a pressing drum, said drum having an axle for mounting said drum for rotation, said axle including journals, primary bearing means mounting said journals to permit rotation of said axle and said drum, and means for heating said drum;

(b) an endless steel belt passing around a major portion of the periphery of said drum and adapted to carry material to be pressed, said material being disposed between said belt and said drum;

(c) a reversing roller for supporting said belt near the point where the product disengages the belt and pressing drum, and a tensioning roller for tensioning said belt;

(d) a plurality of pressure rollers disposed around an arcuate section of said major portion of said periphery of said drum and acting on said belt to urge said material into contact with said drum such that said material is pressed;

(e) lateral support means for mounting said drum assembly at the ends thereof, each of said lateral support means comprising a plurality of independent and interconnected support members, one of said support members carrying said primary bearing means in which said axle of said drum is journalled to rotate; and (f) adjustment means acting on said axle of said drum for providing radial adjustment of said axle to eliminate play between said primary bearing means and said lateral support means and simultaneously to eliminate play between said interconnected support members, said adjustment means comprising secondary bearing means in which said journals of said axle are mounted, said secondary bearing means being disposed axially outwardly of said primary bearing means between said primary bearing means and the free end of said journal means, said secondary bearing means including a bearing body, and hydraulic piston and cylinder means acting on said bearing body, said press further including bracket means mounted on said lateral support means, said hydraulic piston and cylinder means including a first end connected to and acting on said bearing body, and an opposed second end fixed to said bracket means;

whereby the spacing of said drum from said pressure rollers can be precisely adjusted.

2. A press as recited in claim 1, wherein said hydraulic piston and cylinder means comprises a single piston and cylinder assembly, and further including guide arm means disposed in parallel to said piston and cylinder assembly, and said guide arm means having a first end pivotally connected to said bearing body and a second end attached to and supported by said bracket means, and wherein both said piston and cylinder assembly and said guide arm means are disposed above said axle.

3. A press as recited in claim 1, wherein said hydraulic piston and cylinder means comprises two piston and cylinder assemblies in parallel to and adjacent one another, both said assemblies being disposed on the same side of a horizontal plane passing through said axle, both of said piston and cylinder assemblies having first ends pivotally connected to said bearing body and opposed second ends connected to said bracket means.

4. A press for the continuous production of thin chipboards and fibre-boards comprising:

(a) a pressing drum assembly comprising a pressing drum, said drum having an axle for mounting said drum for rotation, said axle including journals, primary bearing means mounting said journals to permit rotation of said axle and said drum, and means for heating said drum;

(b) an endless steel belt passing around a major portion of the periphery of said drum and adapted to carry material to be pressed, said material being disposed between said belt and said drum;

(c) a reversing roller for supporting said belt near the point where the product disengages the belt and pressing drum, and a tensioning roller for tensioning said belt;

(d) a plurality of pressure rollers disposed around an arcuate section of said major portion of said periphery of said drum and acting on said belt to urge said material into contact with said drum such that said material is pressed;

(e) lateral support means for mounting said drum assembly at the ends thereof, each of said lateral support means comprising a plurality of independent and interconnected support members, one of said support members carrying said primary bearing means in which said axle of said drum is journalled to rotate; and (f) adjustment means acting on said axle of said drum for providing radial adjustment of said axle to eliminate play between said primary bearing means and said lateral support means and simultaneously to eliminate play between said interconnected support members, said adjustment mean comprising secondary bearing means in which said journals of said axle are mounted, said secondary bearing means being disposed axially outwardly of said primary bearing means between said primary bearing means and the free end of said journal means, said secondary bearing means including a bearing body, and hydraulic piston and cylinder means acting on said bearing body, said piston and cylinder means being secured at opposite ends thereof to the exterior of said lateral support means at a location spaced substantially from said axle, and to said secondary bearing means, whereby actuation of said piston and cylinder means can precisely adjust the spacing between said drum and said pressure rollers.

* * * * *